US005272774A

United States Patent [19]

Ivko et al.

[11] Patent Number: 5,272,774

[45] Date of Patent: Dec. 28, 1993

[54] TOILET CONVERSION KIT

[76] Inventors: Joseph J. Ivko; Renette M. Ivko, both of 5657 Avista Dr., Sarasota, Fla. 34243

[21] Appl. No.: 927,338

[22] Filed: Aug. 10, 1992

[51] Int. Cl.[5] ..... A61K 35/00; E03D 9/08

[52] U.S. Cl. ..... 4/420.2; 4/420.4

[58] Field of Search ..... 4/420.2, 420.4, 448, 4/DIG. 6, 420.1, 420.3, 420.5, 443–447

[56] References Cited

U.S. PATENT DOCUMENTS

| | | | |
|---|---|---|---|
| 2,214,200 | 9/1940 | Lowther | 4/213 X |
| 2,344,561 | 3/1944 | Popil | 4/420.2 |
| 2,957,180 | 10/1960 | McMullen | 4/420.2 |
| 3,425,066 | 2/1969 | Berger | 4/420.4 |
| 4,406,025 | 9/1983 | Huck et al. | 4/448 X |
| 4,696,673 | 9/1987 | Ledin-Bonevik | 4/448 X |
| 4,998,300 | 3/1991 | Sharifzadeh | 4/420.4 |

FOREIGN PATENT DOCUMENTS

| | | | |
|---|---|---|---|
| 2852511 | 6/1980 | Fed. Rep. of Germany | 4/420.4 |
| 2142055 | 1/1985 | United Kingdom | 4/420.4 |

*Primary Examiner*—Henry J. Recla
*Assistant Examiner*—Robert M. Fetsuga
*Attorney, Agent, or Firm*—Richard R. Mybeck; Richard R. Mybeck

[57] ABSTRACT

A toilet conversion kit comprising a bidet sub-assembly and a dryer sub-assembly. The bidet sub-assembly includes a central yoke member mountable upon a toilet bowl rim and operational to direct water from a suitable and controllable water supply service to a sprayhead which is pivotal into operational juxtaposition with the users bottom either to wash those parts after evacuation or for therapeutic reasons such as the soothing of hemorrhoids, episiotomies or the like. The dryer sub-assembly is especially adapted to mount a conventional hair dryer therewith and direct the flow of warm air generated thereby to dry the parts which have been sprayed by the bidet sub-assembly. Both the water source and the warm air source are readily controlled by the handicapped user thereby eliminating the need for others to be present during these extremely personal activities. Alternate water sources are described.

12 Claims, 2 Drawing Sheets

TOILET CONVERSION KIT

INTRODUCTION

This invention relates generally to means and methods of maintaining human sanitation and more particularly to a novel toilet conversion kit which when associated with a conventional water closet, enhances that appliance with a dryer/bidet function and is especially adapted to provide physically disabled individuals with a degree of privacy while obtaining self-sufficiency and maintaining self-respect heretofore unavailable to them while they were handling their toilet function. Furthermore, the assemblage of the present invention is simple to construct and install, of durable structure, occupies minimal space, and operates with a minimum of movement required from the user.

BACKGROUND OF THE PRESENT INVENTION

Privacy while attaining personal hygiene is important to all self-respecting individuals but it is especially important for the physically disabled individual who, heretofore, has been unable to totally clean-up after completing his/her natural function. Moreover, the presence of an attendant for someone unable to care for himself after toilet use can be an embarrassment for both people involved. Thus a need exists for means to provide an acceptable self-controlled alternative cleansing method for such individuals. While effort has been made to provide such equipment in the past, the prior art units have not been totally acceptable and those which were available were not universally obtainable for a variety of reasons.

These devices, generally referred to as "bidets", are expensive as separate units. Furthermore, many require installation in the bathroom while the bathroom is under construction. Furthermore, after construction, installation of such a fixture to a toilet facility required extensive and expensive remodeling.

Some portable bidet adapters have been suggested by the prior art, but not one is totally satisfactory for a variety of reasons. First, some are restricted to permanent installation to the tank and/or toilet seat and thereby deprive the owner of the versatility obtainable from a portable unit. Others had no independent means to control the flow of water to it other than the control provided by a nearby faucet leaving the user with substantially no control during the process and grossly inconvenient interludes while trying to reach and operate the controls. Still others presented safety hazards because they required water hoses which were draped over the front of the stool. Others depended on electrical sub-assemblies for control and therefore were much more costly to produce and presented a potential risk of electrical shock. Still others had to be removed after each use which was a difficult, if not impossible, task for the physically disadvantaged person and, as such, required the frequent presence of another person in the privacy of the toilet.

Other prior devices of general relevance to the evolution of the bidet art but which failed to provide a device which fulfilled all of the needs of the handicapped person, particularly the bilateral amputee, are described by Rathbone in U.S. Pat. No. 1,346,252 who requires the installation of a special toilet seat; Koppin in U.S. Pat. No. 1,521,892 who requires an independent yoke to support a fluid control valve; as well as Parisini, U.S. Pat. No. 2,104,271; Bigio, U.S. Pat. No. 2,278,055; Popil, U.S. Pat. No. 2,344,561; Van Houten, U.S. Pat. No. 3,430,267; Marcard, U.S. Pat. No. 3,605,124; Alexander, U.S. Pat. No. 4,069,519; Fushimi, U.S. Pat. No. 4,340,980; Ingels, U.S. Pat. No. 4,807,311; and Aoyama, U.S. Pat. No. 4,967,423.

As is apparent from the foregoing art, the use of a sprayhead to cleanse the operator is per se old including the concept of pivoting the sprayhead into and out of operative juxtaposition with the operator's bottom. However, the prior art attempts to create a bidet conversion assembly that was portable, inexpensive to build, easy to install, simple to operate and which created no untoward safety concerns have not been successful. It is toward the realization of that goal that the present invention is directed.

BRIEF SUMMARY OF THE PRESENT INVENTION

The present invention relates generally to means and methods of maintaining human sanitation and providing water therapy for lower body infirmities. More particularly this invention relates to a novel and unique assembly which, when associated with a conventional water closet, provides a dryer/bidet function for its user and which is especially adapted to enable physically disadvantaged individuals to achieve self sufficiency in handling their personal hygiene and/or therapy while maintaining privacy, dignity and self-respect.

More particularly, one aspect of the present invention relates to a specially designed bidet assembly comprising a sprayhead, user controlled valve means for selectively delivering water to the sprayhead, means for detachably securing the assembly to the rim of a toilet bowl, and means for pivotally relocating the sprayhead between an operating and non-obstructing location relative to the user of the toilet. When installed, the assembly fits easily between the seat and the rim of a conventional water closet and requires only minor adjustment to the seat. It is stabilized simply by tightening two detent fasteners, such as bolts, to align the assembly to the pitch of the toilet bowl rim and a third adjustable fastener to secure the device to the rim. The need to hire special help or engage in expensive remodeling of one's abode is thereby avoided. Because of its easy installation and removal, the assembly can be readily transported from site to site by an owner who is visiting friends or traveling on business.

Operation of the device is also easy. The sprayhead is on a swivel so that it remains out of the way until needed. The water supply is controlled by an adjustable actuator allowing the user to control the spray of water. A special control extension bar is provided to extend the range of the valve actuator control lever thereby allowing the valve to be foot controlled.

The present invention further embraces a specially designed dryer assembly means comprising a holster means detachably secured to the outside of water closet and adapted to secure and support a conventional hair dryer in a preselected relationship thereto. A conventional hairdryer is already present in most residential bath rooms and will not need to be acquired. The holster further channels the flow of warm air from the dryer, when the dryer is activated, into contact with the users wet posterior and quickly and gently dries the posterior. When installed, in accordance herewith, the dryer assembly is secured between the seat and the rim of the toilet bowl in a convenient fashion with only minor alteration to the seat. It, like the bidet assembly, can be readily transported.

Accordingly, a primary object of the present invention is to provide a novel and unique toilet conversion kit which is simple to build, easy to install, inexpensive to own, convenient to operate and occupies only minimal space when installed.

Still another object of the present invention is to provide a new and unique toilet conversion kit including a bidet assembly that does not alter the construction of the toilet to which it is attached to facilitate temporary use when visiting friends or traveling on business.

A still further object of the present invention is to provide a new and improved toilet conversion kit including a bidet assembly that can be readily operated by physically impaired individuals, including bilateral amputees, without an attendant present.

Another object of the present invention is to provide a new and improved toilet conversion kit including a dryer assembly for concurrent installation with the bidet assembly to allow a disabled user to perform natural bodily function and thereafter clean and dry himself/herself in absolute privacy and without the need for an attendant.

Still another object of the present invention is to provide a new and improved toilet conversion kit which enables one afflicted with lower body infirmities to readily soothe those infirmities with a readily controlled cascade of water and thereafter dry oneself without requiring third party assistance.

These and still further objects, as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

DESCRIPTION OF PREFERRED EMBODIMENT

The present invention relates generally to means and methods for providing and maintaining human sanitation and more particular to a novel and unique toilet conversion kit identified in the accompanying drawing by the general reference 10. Conversion kit 10 comprises a bidet sub-assembly 12 and dryer sub-assembly 14 which, as shown in FIG. 1, coact to provide an ordinary household toilet with a bidet-dryer function which enables that facility to be used in privacy even by seriously disabled individuals including bilateral amputees.

Figure 1:
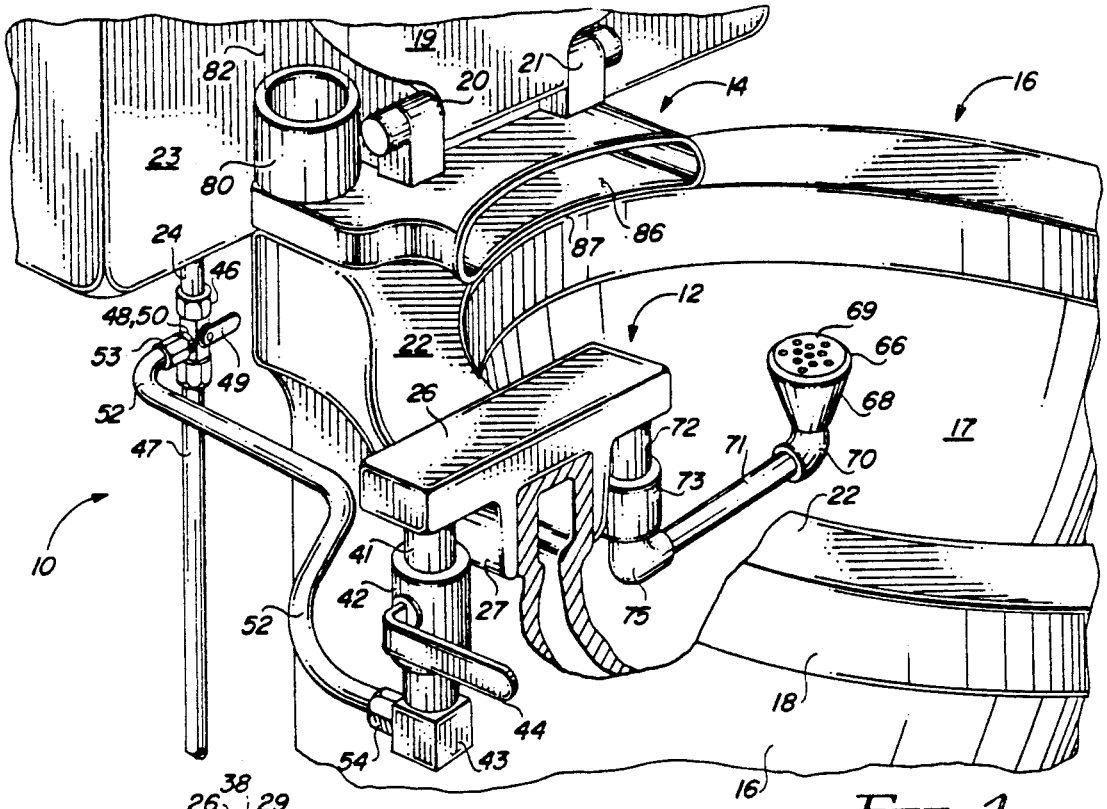
FIG. 1 is an isometric showing of a conventional toilet bowl in combination with a bidet sub-assembly and dryer sub-assembly embodying the present invention.

Referring to FIG. 1, the bidet sub-assembly 12 and the dryer sub-assembly 14 are shown in operative association with a conventional toilet 16 which has a bowl 17 circumscribed by an upper rim or flange 18, a generally annular seat 19 pivotally attached by bolts 20, 21 to the upper surface 22 of rim 18 and therethrough, a water storage tank 23, and a water inlet connector 24 which extends from a water supply line (not shown) to the water storage tank 23. The filling and flushing operation of such a toilet 16 is well known to the art and need not be detailed here.

Figure 2:
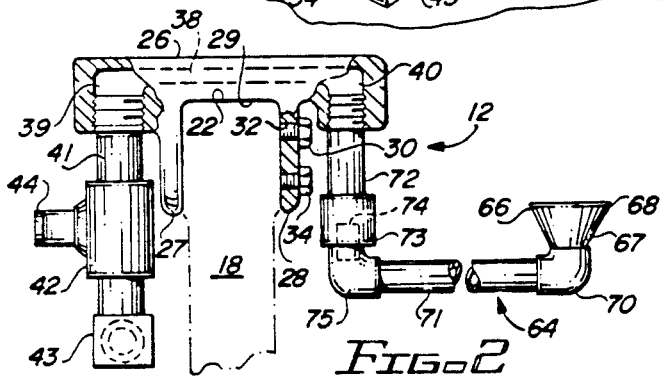
FIG. 2 is a frontal elevation of the bidet sub-assembly of FIG. 1.
Figure 3:
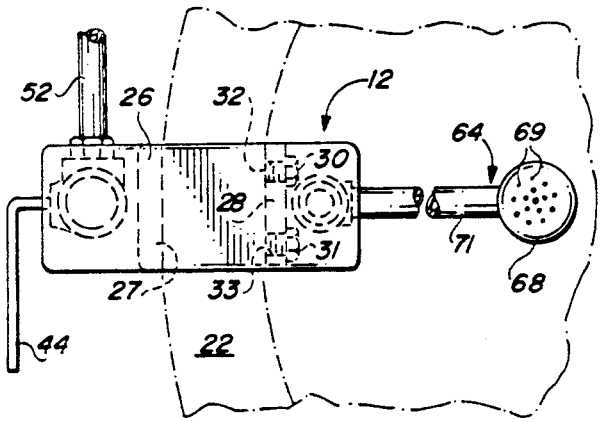
FIG. 3 is a plan view of the bidet sub-assembly of FIG. 2.

As shown in FIGS. 2 and 3, bidet assembly 12 comprises a central yoke 26 having a first and a second flange member 27, 28, depending therefrom in spaced generally parallel relationship to each other and a lower support surface 29 adapted to rest on the upper surface 22 of bowl rim 18 of a conventional toilet bowl 17. As described above, a conventional toilet seat 19 is suitably attached to toilet bowl 17 for pivotal action relative thereto by suitable securing means such as bolts 20, 21.

Central yoke 26, when placed so that surface 29 engages surface 22 in surface-to-surface engagement therewith, is aligned by turning bolts 30, 31 which are threadably engaged in and extend through suitable threaded openings 32, 33 which are defined in and through flange 28 until flange 28 is truly vertical. In this sense, bolts 30, 31 function as spacers which allow sub-assembly 12 to be installed on a variety of toilet bowls irrespective of the thickness of rim 18. A third bolt 34 is utilized as a detent and extends through a complementary opening 35 in flange 28 and engages the side of bowl 17 beneath rim 18 and in such a manner prevents yoke 26 from being unintentionally removed from bowl rim 18.

Figure 4:
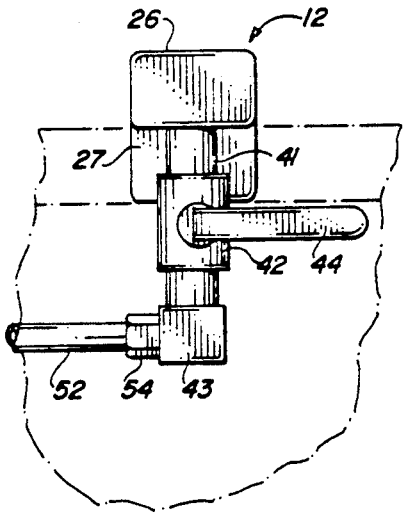
FIG. 4 is an end elevation of the bidet sub-assembly of FIG. 2.

As shown in FIGS. 2, 3 and 4, central yoke 26 has a hollow passage 38 defined therethrough and extending between water inlet 39 at one end thereof, and water outlet 40 at the other end thereof.

A suitable water source (not shown but readily accessible in most residential bathrooms) is connectable to water inlet 39 by a suitable nipple 41 which extends therefrom into central valve 42 which in turn is operatively connected by means of a suitable fitting 43 to the water source in the manner to be hereinafter described. Central valve 42 is provided with an elongated handle 44 to facilitate opening and closing the valve 42 to control the flow or lack of flow of water therethrough.

When permanent or semi-permanent installation of kit 10 is desired, a simple T-connector 46 can be installed into toilet tank water feed line 24 as shown in FIG. 1. T-connector 46 comprises body portion 47 extending coaxially with feed line 24, an outwardly extending arm portion 48 having a valve 49 disposed therein and a suitable connector means such as threaded male fastener 50 on the remote end thereof, downstream of valve 49. A suitable conduit such as hose 52 is operatively interposed between and secured to connector means 50 at one end thereof and to water inlet fitting 43 at the other end thereof to permit water under normal city pressure to be delivered to central valve 42 from water source when T-connector valve 49 is in the open position. Hose 52 can be easily cut to the desired length and suitable fittings 53, 54 affixed to each end thereof for coactive engagement with connector means 50 and fitting 43, respectively.

Alternate water supply systems can be employed with the traveling or portable embodiment of kit 10 because of the obvious impracticality of installing a T-connector 46 into the water supply line 24 of every toilet visited.

Figure 10:
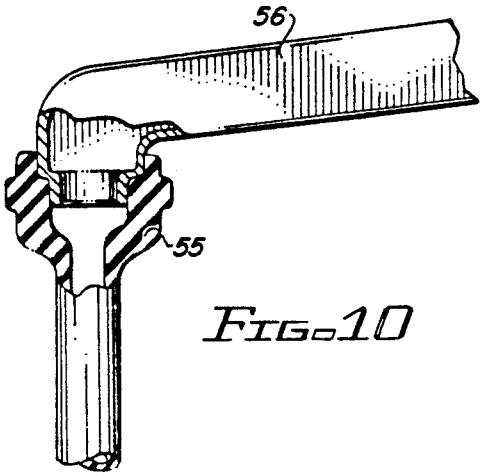
FIG. 10 is a cross-sectional view of a water-faucet connector for use with the present invention.

One alternative water supply system, suitable for use in most residential bathrooms which one might visit comprises an extension hose 5 which is slightly longer than before but which includes fitting 54 on the one end thereof for connection in water-tight engagement with fitting 43. A different second fitting 55 is mounted on the far end thereof adapted for water-tight circumscribing engagement with a conventional water faucet as shown in FIG. 10.

Figure 9:
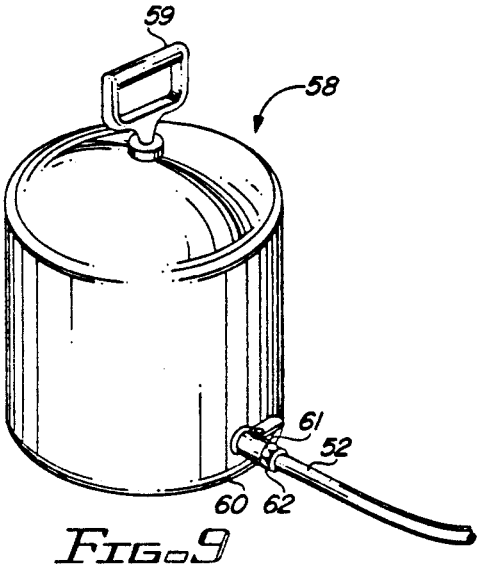
FIG. 9 is a side elevation of an auxiliary tank for use with the present invention.

Another alternative water source, while more cumbersome to handle, is nonetheless useful when attending functions at a modern hotel where, for some reasons, lavatories and toilet stalls are now located in discrete bays and the stringing of an extension hose between a wash basin and a toilet stall is totally impractical. This alternative, as shown in FIG. 9, comprises a portable tank 58 formed of a suitable pressure-resistant material which may be steel but preferably will be a lighter weight plastic material capable of withstanding up to about 40–50 psi internal pressure when fully loaded and which is of a size to contain about 2 gallons of water.

A conventional pump pressure generating means 59 extends downwardly in tank 58 and is operable to impart the desired pressure to the water contained therein. Adjacent the lower edge 60 of tank 58, is valved outlet 61 which is provided with a suitable fitting 62 which is complementary to and coactive with the proximal fitting 55 of extension hose 52 and operative to provide water under pressure to hose 52 for delivery to central valve 42 just as before.

Referring to FIGS. 2 and 3, bidet sub-assembly 12 further comprises an upstanding sprayhead 66 having a hollow body portion 67 and a foraminous cover portion 68 disposed transversely thereacross and, in a preferred practice, integrally formed therewith. The individual openings 69 in cover portion 68 are preferably of approximately ⅛" in diameter so that the pressurized water emitted therefrom creates more of a cascading effect rather than a needle effect, as it strikes the user. A suitable fitting 70 is secured to the lower edge of body portion 67 for receiving hollow extension arm 71 in water-tight communicative relationship therein. Interposed between extension arm 71 and yoke channel outlet 40 is a nipple pipe member 72 which is inserted in and secured to channel outlet 40 and depends therefrom for engagement by a hollow mechanical water-tight swivel means 73 having a hollow threaded stub 74 (shown in dotted lines) depending therefrom for communicative connection to hollow arm 71 by means of pipe elbow 75. When thus assembled, sprayhead assembly 64 is suitably connected to water outlet 40 of central yoke 26 by an elbow 75 and connector nipple pipes 71, 72 having hollow mechanical water-tight swivel means 73 interposed therebetween to permit sprayhead 66 to be supplied with water and to be rotated about swivel means 73 for purposes to be hereinafter described.

Figure 5:
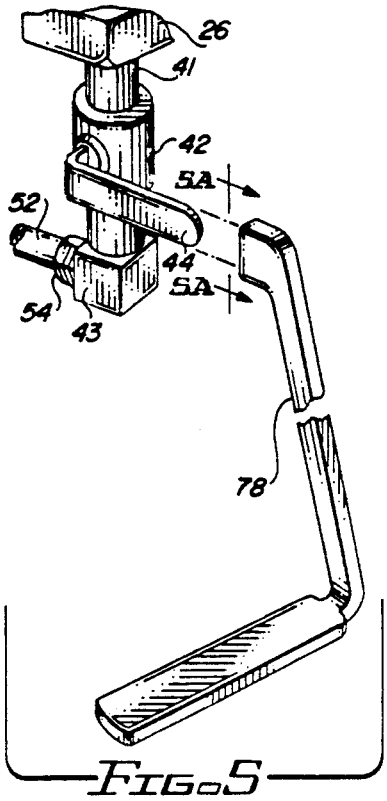
FIG. 5 is an isometric view of a valve and control bar embodying the present invention.
Figure 6:
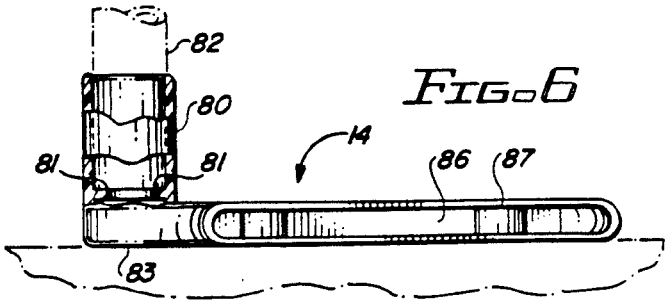
FIG. 6 is a front elevation of the dryer sub-assembly of FIG. 1.
Figure 7:
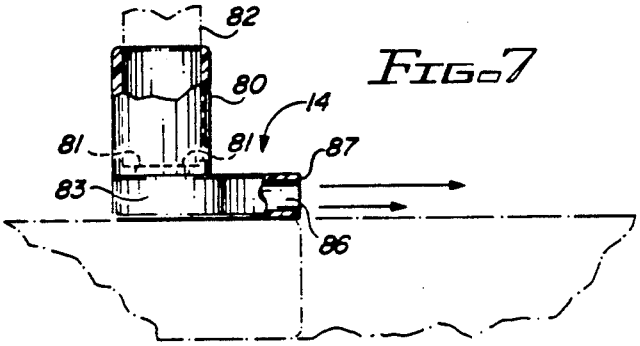
FIG. 7 is an end elevation of the dryer sub-assembly of FIG. 6.
Figure 8:
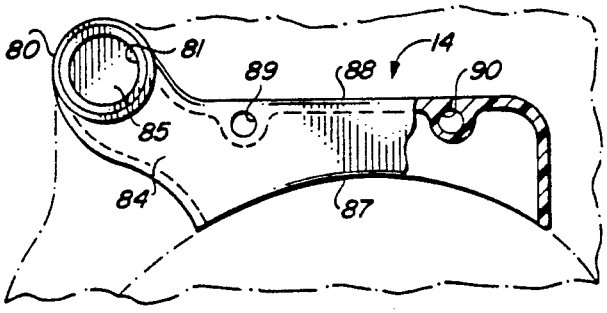
FIG. 8 is a plan view of the dryer sub-assembly of FIG. 7.
Figure 5A:
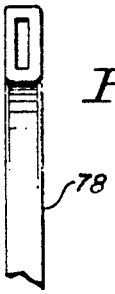
FIG. 5A is an end elevation, partially broken away, of the control bar of FIG. 5.

To facilitate ease of operation for all users but of necessity for those whose disability requires foot operation of sub-assembly 12, an extended actuator arm 78 as shown in FIG. 5, is attached to and extends outwardly from handle 44 of valve 42 whereupon valve 42 can be conveniently activated and controlled by the user's foot.

Concurrently with the installation of the bidet sub-assembly 12, conversion kit 10 further comprises a dryer sub-assembly 14 which shall now be described.

As shown in FIGS. 1, 6, 7 and 8 of the drawing, dryer sub-assembly 14 comprises a cylindrical holster 80, having seating means 81 defined therein to support a suitable warm air source, such as hair dryer 82 when it is disposed telescopically within the holster 80 and seated upon seating means 81 in spaced relationship to the bottom surface 83 thereof. A diffusion chamber 84 having an intake port 85 operatively interposed for communication between chamber 84 and holster 80, and a exhaust port 86, disposed in communicating relationship between chamber 84 and the toilet bowl 17 with which it is associated, extends laterally from holster 80 across rim 18. Chamber 84 is provided with a contoured leading edge 87 and a trailing portion 88. Trailing portion 88 is provided with suitable openings 89, 90 for receiving bolts 20, 21 therethrough to attach and suitably secure dryer sub-assembly 14 between the toilet bowl 17 and the seat 19 as will be hereinafter described in greater detail.

In one practice of the present invention, bidet sub-assembly 12 is assembled by taking central yoke 26 and threadedly connecting nipple 41 into water inlet 39 and nipple 72 into water outlet 40 so that both are in communicative relationship with passage 38. A suitable valve member 42 is then threadedly attached to the lower end of inlet nipple 41 and fitting 43 is threadedly engaged into valve 42 to complete the ingress end of the yoke 26.

Sprayhead assembly 64 is next assembled in the following fashion. Extension arm 71 is threadedly engaged at one end thereof into fitting 70 extending from body portion 67 and at the other end thereof, into threaded engagement with elbow 75. Elbow 75 is then threadedly engaged with stub 74 which depends from swivel means 73. Nipple 72 is threadedly engaged into yoke outlet 40 and upon connecting nipple 72 to swivel means 73, the egress end of sub-assembly 12 is complete.

To install the conversion kit for home use, a simple T-connector 46 is first installed into the toilet tank water feed line 24 and the extending arm portion 48 presents threaded connector means 50 for connection to the toilet as will be hereinafter described. The bidet sub-assembly 12 is mounted by lifting toilet seat 19 to expose toilet bowl rim 18 and placing yoke 26 thereon so that support surface 29 engages rim 18 in surface-to-surface engagement therewith and sprayhead assembly 64 is disposed inside toilet bowl 17. The yoke 26 is then aligned to the bowl 17 by advancing bolts 30, 31 through openings 32, 33 respectively, until the leading ends thereof engage bowl 17 and flange 28 is in an upright position. Next bolt 34 is advanced until it engages bowl 17 beneath rim 18 thereby preventing accidental removal of the yoke 26 from the bowl 17. As installed, seat 19 can be raised and lowered without any alteration in its relationship to rim 18 and without any impediment as a result of yoke 26. Sprayhead 66 is moved into a non-obstructing location adjacent to the side of the bowl 17 from whence it is pivotal for use when desired. A suitable conduit such as hose 52 is attachable by fitting 53 to connector 50 and by fitting 54 to water inlet fitting 43. When valve 49 of T-connector 46 is opened, water from the toilet supply line 24 advances for final selective control by central valve 42 and bidet sub-assembly 12 is ready for use.

Installation of the dryer sub-assembly 14 requires the removal of the toilet seat 19. The nut fasteners (not shown) which lock bolts 20, 21 which secure seat 19 to toilet bowl 17 are removed, enabling seat 19 and bolts 20, 21 to be lifted off of bowl 17. Dryer sub-assembly 14 is then placed on the rear ledge of bowl 17 so that the openings 89, 90 defined as described in trailing portion 88, are positioned in registry with the holes (not shown) from which bolts 20, 21 were removed and so that contoured leading edge 87 of chamber 84 conforms to the inner curvature of toilet bowl 17. In this position, the holster 80 is outside of toilet bowl 17, and the exhaust port 86 of chamber 84 is directed into the interior of toilet bowl 17. Bolts 20, 21 are then replaced by passing through openings 89, 90 and through bowl 17 and the nut fasteners are then threaded into place to secure seat 19 to bowl 17 essentially as it was before removal. In some installations, however, resilient pressure-sensitive spacer pads (not shown) extending up to about ¾ of an inch may be attached to the front edge of rim 18 to assure absolute horizontal orientation of toilet seat 19 when it is a ready-for-use position. Alternatively, the spacers may be attached to the underside of seat 19 in the same proximate location.

A warm air source such as a conventional hair dryer 82 is placed with its snout in holster 80 until it seats upon seating means 81 so that when dryer 82 is suitably connected to an electric power source, dryer sub-assembly 14 is ready for use by activation of hairdryer 82 in the normal fashion.

Another embodiment of the present invention employs an alternative water source such as may be required when visiting the home of another. Sub-assemblies 12 and 14 are installed as before but extension hose 52 will be longer and will have a fitting 55 on the distal end thereof which is complementary to a sink faucet 56 to permit the sink faucet 56 to be used as a transient water supply. Fitting 53 which complements and coacts with central valve fitting 43 remains constant. Likewise, when portable tank 58 is used as a temporary water supply, hose 52 will be equipped at its distal end with a fitting which complements fitting 62 on portable pressurizable tank 58.

Reverting to the principal embodiments of the present invention, the kit 10, when installed as described, is activated by initiating the water supply either by opening valve 49 at T-connector 46 or by opening the faucet at the sink. After evacuation is complete, the sprayhead 66 is pivoted into operative position beneath the user's posterior and central valve 42, with or without optional extender 78 attached to handle 44, is opened to permit water to flow into and through yoke 26 and out of sprayhead assembly 64 and out of sprayhead 66 onto the user's posterior, thereby cleansing the user with a gentle cascade of water. The time required to effectively clean after an average stool is 20 seconds or less. Valve 42 is then closed which stops the flow of water and sprayhead 66 is pivoted into its inactive position. To dry, the warm air source, such as the hair dryer 82, which has been previously placed in holster 80 of dryer sub-assembly 14 and plugged into a suitable electric power source, is turned on, forcing warm air into and through chamber 84 and out the exhaust port 86 where the stream of warm air engages the wet posterior and dries the water therefrom. The user will be dry in approximately 40 plus seconds depending on the air temperature and velocity of the air flow. The dryer is then turned off and the cleaning process is complete.

As is apparent to those skilled in the art, a variety of materials are available for making the bidet assembly, including copper, polyvinyl chloride, and like materials capable of channeling water under pressure and which do not react therewith. Further, the bidet assembly can be injection molded and the parts can be colored to complement or match the colors of conventional toilet bowls thereby creating a decorative as well as highly functional accessory for the bathroom.

From the foregoing, it is readily apparent that a useful embodiment of the present invention has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. A toilet conversion kit for a toilet having a bowl with a curvilinear rim and a toilet seat superposed thereto, said conversion kit having a bidet sub-assembly and a dryer sub-assembly cooperatively interactive to provide self-controllable personal hygiene for a handicapped user of such toilet, said bidet sub-assembly comprising: a water source; sprayhead means for spraying water; a central yoke mountable upon said toilet, said central yoke including means for receiving water from said water source and delivering said water to said sprayhead means, means for detachably securing said central yoke to said toilet, means for operatively securing said sprayhead means to said central yoke, and means for selectively controlling the amount of water received from said water source and delivered through said central yoke to said sprayhead means and, said dryer sub-assembly comprising: cylindrical holster means for receiving a warm air source and having a bottom surface, seating means disposed within said cylindrical holster means for supporting said warm air source within said holster means in spaced relationship to said bottom surface, a chamber disposed in operative communication with said holster means for receiving warm air from said warm air source and delivering said warm air into said toilet, said chamber having a curvilinear leading edge adapted to conform to the interior contour of the toilet bowl rim and a trailing edge, said trailing edge having means defined therein for securing said chamber to said toilet intermediate said rim and the toilet seat.

2. A toilet conversion kit according to claim 1 in which said means for operatively securing said sprayhead means includes means for selectively pivoting said sprayhead means between an operational and a stored position.

3. A toilet conversion kit according to claim 1 in which said means for selectively controlling the amount of water includes valve means operatively associated therewith, said valve means having a foot activated actuator means operatively associated therewith to facilitate the opening and closing of said valve means to control the amount of water passing therethrough.

4. A toilet conversion kit according to claim 2 in which said means for selectively controlling the amount of water includes valve means operatively associated therewith, said valve means having a foot activated actuator means operatively associated therewith to facilitate the opening and closing of said valve means to control the amount of water passing therethrough.

5. A toilet conversion kit according to claim 1 in which said warm air source is an electric hair dryer telescopically inserted into said cylindrical holster means.

6. A toilet conversion kit according to claim 5 in which said chamber has a curvilinear leading edge adapted to conform to the interior contour of the toilet bowl rim and a trailing edge, said trailing edge having means defined therein for securing said chambre to said toilet intermediate said rim and the toilet seat.

7. A toilet conversion kit according to claim 6 in which said sprayhead means includes means for selectively moving said sprayhead means in a horizontal plane between an operational and a stored position.

8. A toilet conversion kit according to claim 7 in which said means for selectively controlling the amount of water includes valve means, said valve means having foot activated actuator operatively associated therewith to facilitate the activation of said valve means.

9. A toilet conversion kit according to claim 1 in which said sprayhead means includes means for selectively moving said sprayhead means in a horizontal plane between an operational and a stored position.

10. A toilet conversion kit according to claim 9 in which said means for selectively controlling the amount of water includes valve means, said valve means having foot activated actuator operatively associated therewith to facilitate the activation of said valve means.

11. A toilet conversion kit according to claim 1 in which said water source is a central plumbing system.

12. A toilet conversion kit according to claim 1 in which said water source is a pressurizable portable tank.

* * * * *